US006071029A

United States Patent [19]

Weinstock

[11] Patent Number: 6,071,029

[45] Date of Patent: Jun. 6, 2000

[54] GEL DISPENSING BRUSH

[76] Inventor: Jesse Weinstock, 3030 N. Quincy St., Arlington, Va. 22207

[21] Appl. No.: 09/252,823

[22] Filed: Feb. 19, 1999

[51] Int. Cl.[7] ..... B43K 5/04

[52] U.S. Cl. ..... 401/158; 401/280; 401/153; 401/161; 401/163

[58] Field of Search ..... 401/280, 153, 401/164, 169, 158, 161, 162, 163, 181, 179

[56] References Cited

U.S. PATENT DOCUMENTS

| | | | |
|---|---|---|---|
| 912,719 | 2/1909 | McMurran . | |
| 1,413,384 | 4/1922 | Beyermann | 401/280 X |
| 1,434,844 | 11/1922 | Reinholz | 401/280 X |
| 1,793,891 | 2/1931 | Zieschang | 401/179 |
| 2,116,864 | 5/1938 | Fehrenbach . | |
| 2,226,663 | 12/1940 | Hill et al. . | |
| 2,554,641 | 5/1951 | Sears | 401/164 |
| 2,569,276 | 9/1951 | Baptist . | |
| 2,594,721 | 4/1952 | Beebe . | |
| 2,630,594 | 3/1953 | Fisher | 401/280 X |
| 2,897,826 | 8/1959 | Di Vito . | |
| 2,922,425 | 1/1960 | Lerner et al. . | |
| 2,943,602 | 7/1960 | Rundle . | |
| 2,952,026 | 9/1960 | Pland . | |
| 3,137,305 | 6/1964 | Jones | 401/153 X |
| 3,463,170 | 8/1969 | McCullough . | |
| 3,491,777 | 1/1970 | Grosbard . | |
| 4,143,667 | 3/1979 | Peilet . | |
| 4,237,822 | 12/1980 | Kaiser, Jr. . | |
| 4,543,913 | 10/1985 | Wilkeson . | |
| 4,977,909 | 12/1990 | Chou . | |
| 5,297,882 | 3/1994 | Kornides . | |
| 5,338,124 | 8/1994 | Spicer et al. . | |
| 5,443,321 | 8/1995 | Dolan et al. . | |
| 5,746,531 | 5/1998 | Izhak . | |
| 5,755,241 | 5/1998 | Cheung . | |
| 5,758,984 | 6/1998 | Doherty . | |

FOREIGN PATENT DOCUMENTS

| | | | |
|---|---|---|---|
| 314734 | 2/1934 | Italy | 401/153 |

*Primary Examiner*—David J. Walczak
*Attorney, Agent, or Firm*—Jacobson, Price, Holman & Stern, PLLC

[57] ABSTRACT

A gel dispensing hair brush having a plurality of hollow bristles tapering from a head of the brush to a free end at a tip of the bristle for dispensing a gel from within a storage reservoir of the brush. The bellows or storage device from which the gel is dispensed is maintained between four guide ramps located surrounding the bellows. Each opposed set of guide ramps intersects at an obtuse angle so as to guide the sides of the bellows upwardly as the bellows is compressed by a compression plate. Compression of the bellows is achieved by rotation of a thumb wheel extending through the handle of the brush. The recesses and projections of the thumb wheel interengage with complementary shaped recesses and projections found on a toothed side of an indexing bar. On an opposite side of the indexing bar, opposite to the thumb wheel, is a smooth guide roller for maintaining an accurate movement of the indexing bar between the thumb wheel and guide roller. A dispensing plate is movable under the head of the brush. The dispensing plate includes holes approximately 2 mm in diameter, equal to approximately ⅔ of the diameter of the open base of the dispensing bristles. The diameter of the open base of the dispensing bristles is 3 to 4 mm, and preferably 3 mm.

20 Claims, 4 Drawing Sheets

GEL DISPENSING BRUSH

FIELD OF THE INVENTION

The present invention relates to a gel dispensing hair brush having a variable quantity of gel being dispensed through hollow bristles included within a plurality of rigid bristles of the brush.

BACKGROUND OF THE INVENTION

Various devices are known for dispensing hair products such as gels, conditioners, water and hair spray, to name a few, for application to the hair or scalp of the user. These devices may include motorized pressure building devices for forcing hair products through a brush or other applicator. Usually, the amount of hair product dispensed is not controllable. This leads to undesired hair conditions.

SUMMARY OF THE INVENTION

Accordingly, it is a object of the present invention to provide a gel dispensing hair brush having a plurality of hollow bristles tapering from a head of the brush to a free end at a tip of the bristles for dispensing a hair gel from within a storage reservoir of the brush. The term gel as used in accordance with the principles of the present invention is used to describe any hair care product having a viscosity such that it may be stored in a reservoir of the brush and forced, by compression of a storage device through the tapered, hollow bristles projecting from the brush head, in measured quantities.

The hollow bristles are inter-dispersed amongst a plurality of stiff brushing bristles such as would normally be found projecting from a head of a hair brush. The inter-dispersion of the hollow, tapered bristles (dispensing bristles) throughout the brush head, provides for an even distribution of dispensed gel.

The bellows or storage device from which the gel is dispensed is maintained between four guide ramps located surrounding the bellows. Each opposed set of guide ramps intersects at an obtuse angle so as to guide the sides of the bellows upwardly as the bellows is compressed by a compression plate.

Compression of the bellows is achieved by rotation of a thumb wheel extending through the handle of the brush. The recesses and projections of the thumb wheel interengage with complementary shaped recesses and projections found on a toothed side of an indexing bar. On an opposite side of the indexing bar, opposite to the thumb wheel, is a smooth guide roller for maintaining an accurate movement of the indexing bar between the thumb wheel and guide roller.

One side of the indexing bar includes a stop which can move between opposite ends of a groove in one of two guide plates located on opposite sides of the indexing bar. An opposite end of the indexing bar from the end engaged between the thumb wheel and guide roller extends around a guide wheel and terminates in a compression plate.

By rotation of the thumb wheel projecting through an opening in the handle of the brush, the indexing bar is moved so as to force the compression plate towards the bellows containing the gel to be dispensed. The four guide ramps surrounding the bellows help guide the compression of the bellows to allow gel to be forced toward the dispensing bristles located at the open end of the bellows.

A dispensing plate is movable under the head of the brush. The dispensing plate includes holes approximately 2 mm in diameter, equal to approximately ⅔ to 2 times the diameter of the open base of the dispensing bristles. The diameter of the open base of the dispensing bristles is 1 to 4 mm, and preferably 3 mm.

The dispensing plate is connected to a slide switch projecting through an opening in the handle of the brush. The slide switch is movable to move the dispensing plate such that the openings in the dispensing plate are moved into and out of alignment with the open base of the dispensing bristles. When the holes in the dispensing plate are aligned at least partially with the base of the dispensing bristles, compression of the bellows by the compression plate will force gel to be dispensed into the dispensing bristles. Initially, the gel will be forced to fill the interior volume of the dispensing bristles until gel reaches the free end tips of the dispensing bristles. The opening at the free end tip is approximately 1 mm in diameter. Accordingly, a ratio of the diameter of the free end tip to the base opening is in the range of 1:1–1:4, and preferably 1:3.

Upon continued movement of the compression plate, by rotation of the thumb wheel, gel will be forced from the free end tips of the dispensing bristles, preferably as the brush is being applied to the hair of the user. Small movement of the wheel will cause gel to be dispensed. Therefore, the quantity of gel dispersed is accurately applied.

The gel reservoir is refillable through a refill spout projecting through a side wall of the brush. The spout is in communication with the reservoir. Upon depleting of the reservoir, the reservoir may be refilled simultaneously with the movement of the compression plate to its original position by reverse rotation of the thumb wheel so that a vacuum is created in the bellows to assist in sucking gel from an external source to refill the reservoir through the refill spout.

Accordingly, it is another object of the present invention to provide a gel dispensing hair brush having a reservoir in the form of a bellows which is compressed by movement of a compression plate by actuation of a thumb wheel.

It is still another object of the present invention to provide a gel dispensing hair brush having a plurality of hollow, tapered dispensing bristles inter-dispersed with a plurality of straight bristles on the head of a hair brush with the amount of gel dispensed through the dispensing bristles being controlled by a slidably mounted dispensing plate including a plurality of holes for allowing blockage of passage of gel from a reservoir to the dispensing bristles.

It is still yet another object of the present invention to provide a gel dispensing hair brush having a reservoir for gel in the form of a bellows having guide ramps on four sides of the bellows to aid in collapsing of the bellows upon compression of the bellows by a compression plate.

It is still yet another object of the present invention to provide a gel dispensing hair brush having a reservoir including a bellows containing hair gel which is compressed by rotation of a thumb wheel and movement of an indexing bar to force a compression plate into engagement with the bellows and force hair gel through hollow, tapered gel dispensing bristles inter-dispersed between a plurality of straight bristles.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
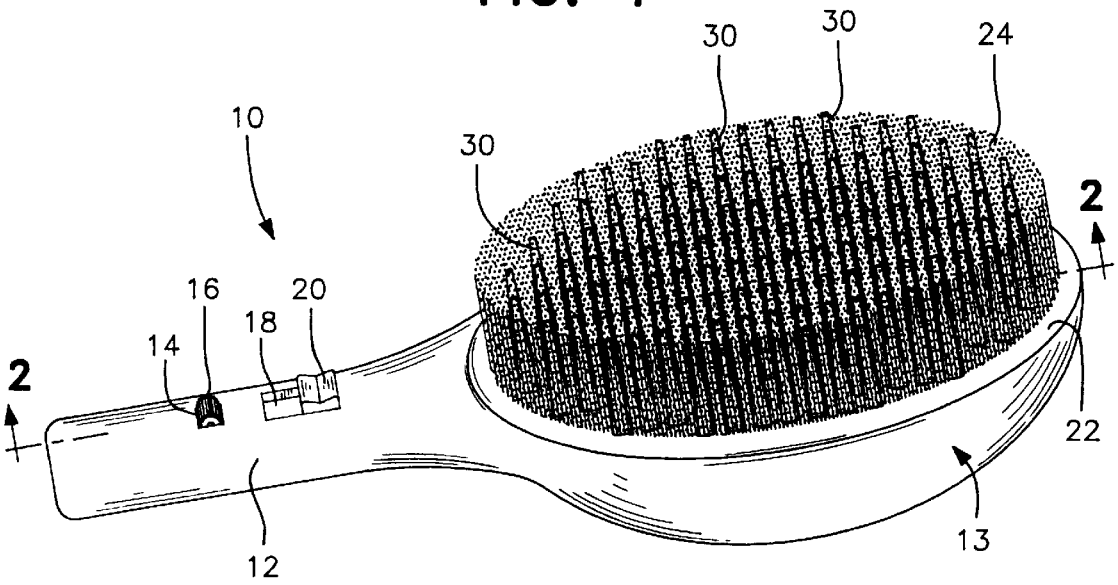
FIG. 1 is a perspective view of the gel dispensing hair brush of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
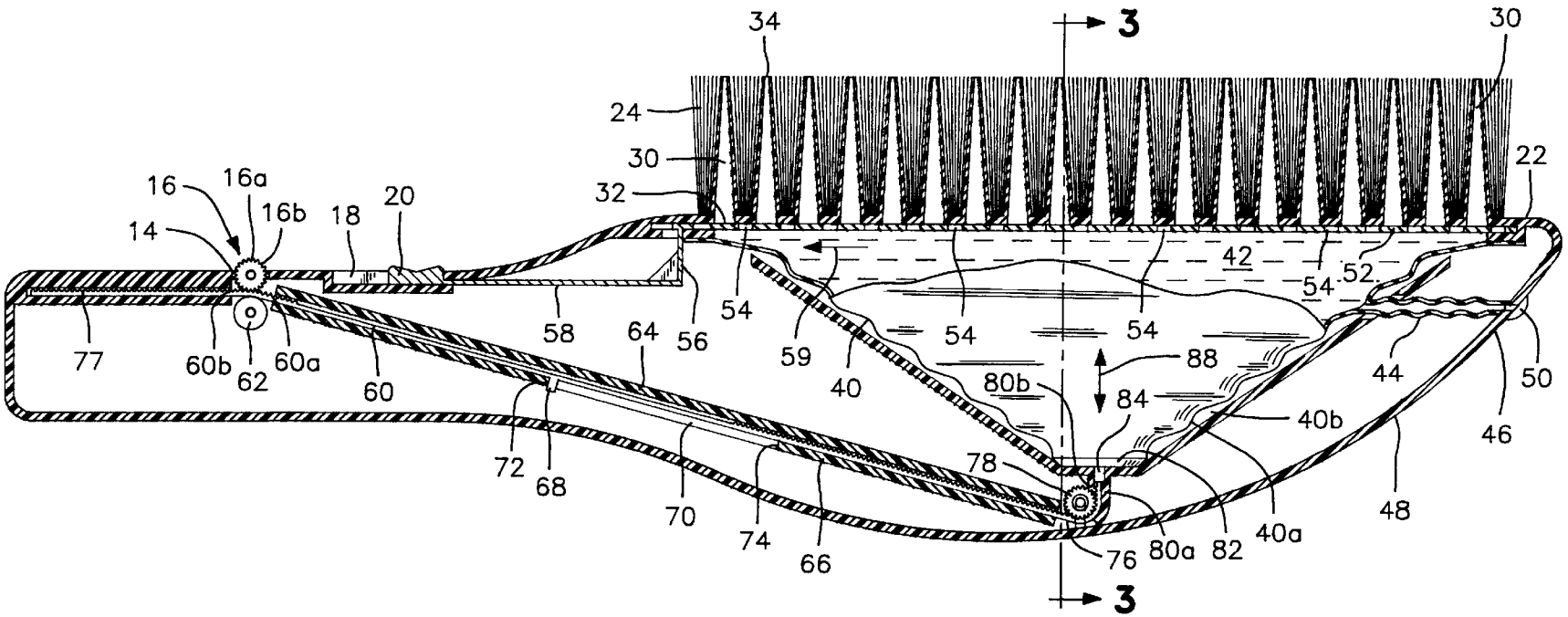
FIG. 2 is a longitudinal sectional view taken along line 2—2 of FIG. 1 and illustrating a full reservoir of hair gel contained in a bellows in a head of the hair brush.

With reference to the drawings, in general, and to FIGS. 1 and 2, in particular, a gel dispensing brush embodying the teachings of the subject invention is generally designated as 10. With reference to its orientation in FIG. 1, the gel dispensing brush includes a handle 12 and a brush body 13.

In the handle 12 is located an opening 14 through which projects a thumb wheel 16. Also, an opening 18 is provided within which is slidably mounted a slide switch 20.

On one side 22 of the body 13 are located a plurality of bristles including rigid bristles 24 defining the outline of an ellipse. Inter-disbursed in the bristles 24 are nine rows of tapered, hollow bristles 30.

With reference to FIG. 2, the tapered hollows bristles 30 include an opening 32 located at the surface 22 of the brush head and at an opposite end from the base opening 32 is a free end tip opening 34. The diameter of the base opening 32 is in the range of 1 to 4 mm, and preferably 3 mm. The tip opening 34 has a diameter of approximately 1 mm. As shown in FIG. 2, the hollow tapered bristles 30 are empty for illustrative purposes.

Located below the bristles 30 is a gel reservoir formed by a bellows 40. The outer surface of the bellows 40 includes a plurality of landings 40*a* and risers 40*b* to form a stair step configuration for ease of collapsibility.

The bellows 40 is filled with a hair gel 42. The reservoir is filled through a spout 44 communicating with the interior of the bellows 40 and leading to an exterior port 46 formed in a sidewall 48 of the brush head. A cap 50 seals the passageway of the spout 44 when a sufficient quantity of gel 42 is present in the bellows 40.

Figure 4:
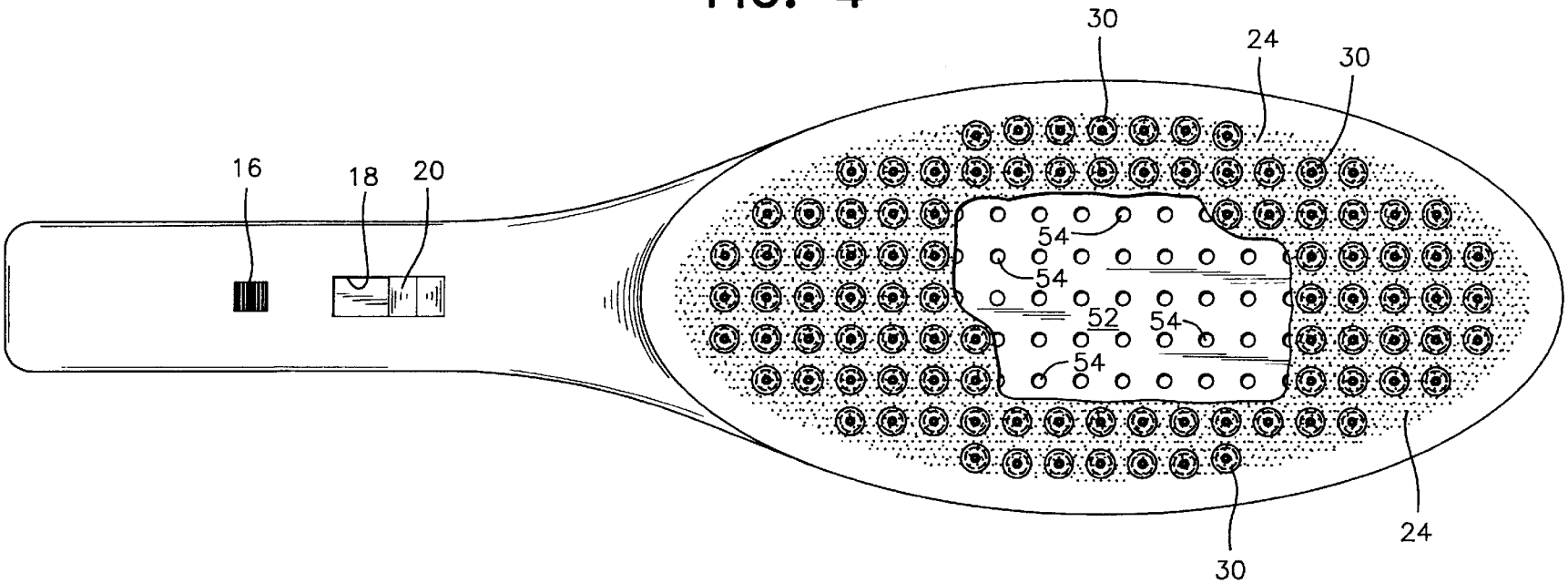
FIG. 4 is a partial cut away plan view of the gel dispensing brush of the present invention, partially illustrating the slidably mounted dispensing plate movable into and out of alignment with a base opening of the tapered, hollow bristles so as to allow dispensing of hair gel from the reservoir to and through the bristles.

Separating the bellows 40 and the hollow bristles 30 is a dispensing plate 52. The dispensing plate includes a plurality of apertures 54 having a diameter of approximately 2 mm. As shown in FIG. 4, the orientation of the rows of apertures 54 is in alignment with the hollow bristles 30. The apertures of the dispensing plate 52 are movable into and out of alignment with the base openings 32 of the hollow bristles 30 by the sliding of the slide switch 20. As shown in FIG. 2, the dispensing plate 52 is connected by arms 56, 58 with the slide switch 20 sliding within opening 18.

When the apertures 54 are out of alignment with the base openings 32, gel 42 is prevented from being forced into the hollow bristles 30. However, when the slide switch 20 is moved from the position shown in FIG. 2 to the opposite end of slot 18, the dispensing plate is moved in the direction of arrow 59 so as to align the apertures 54 with the base openings 32 of the hollow bristles 30. This allows gel to be forced from the bellows 40 into the hollow bristles 30.

To achieve the movement of gel into the hollow bristles 30, the thumb wheel 16, having a plurality of alternating projections 16*a* and recesses 16*b*, is rotated in a counterclockwise direction. The alternating projections and recesses engage in complementary shaped projections 60*a* and recesses 60*b* of indexing bar 60. As supported by guide roller 62, the indexing bar is moved in a direction from that shown in FIG. 2 to the position shown in FIG. 2A. An upper guide plate 64 opposed to a lower guide plate 66 helps direct the movement of the indexing bar 60. A tab 68, slidably mounted in a slot 70 of the lower guide plate 66 limits the amount of movement of the indexing bar from the fully retracted position shown in FIG. 2, abutting surface 72 of slot 70 and at its terminus, engaging surface 74 of the slot 70 in guide plate 66.

An end 76 of the indexing bar, opposite to end 77 which is engaged with the thumb wheel 16, passes around a gear wheel 78 having recesses and projections shaped complementary to corresponding recesses and projections in the end 76 of the indexing bar 60. End 76 of the indexing bar passes from between the upper and lower guide plates 64, 66, around wheel 78 and between vertically oriented guide plates 80*a*, 80*b*. The terminal end of the indexing bar is attached to a compression plate 82 at a stem 84.

Figure 3:
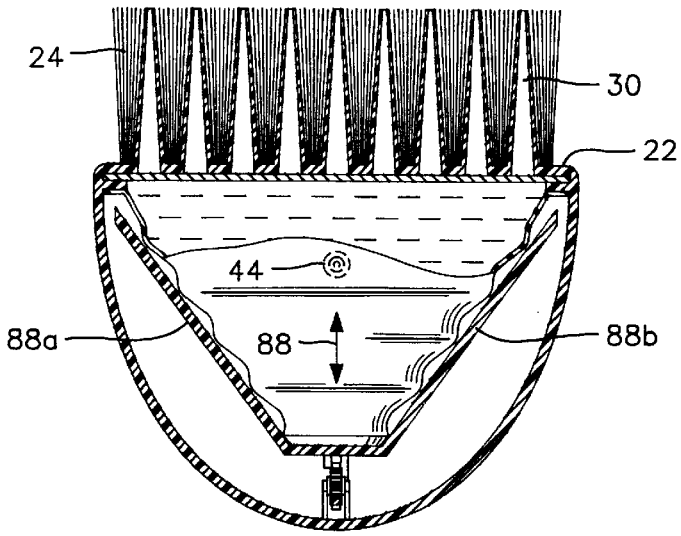
FIG. 3 is a cross-sectional view taken along line 3—3 of FIG. 2.
Figure 2A:
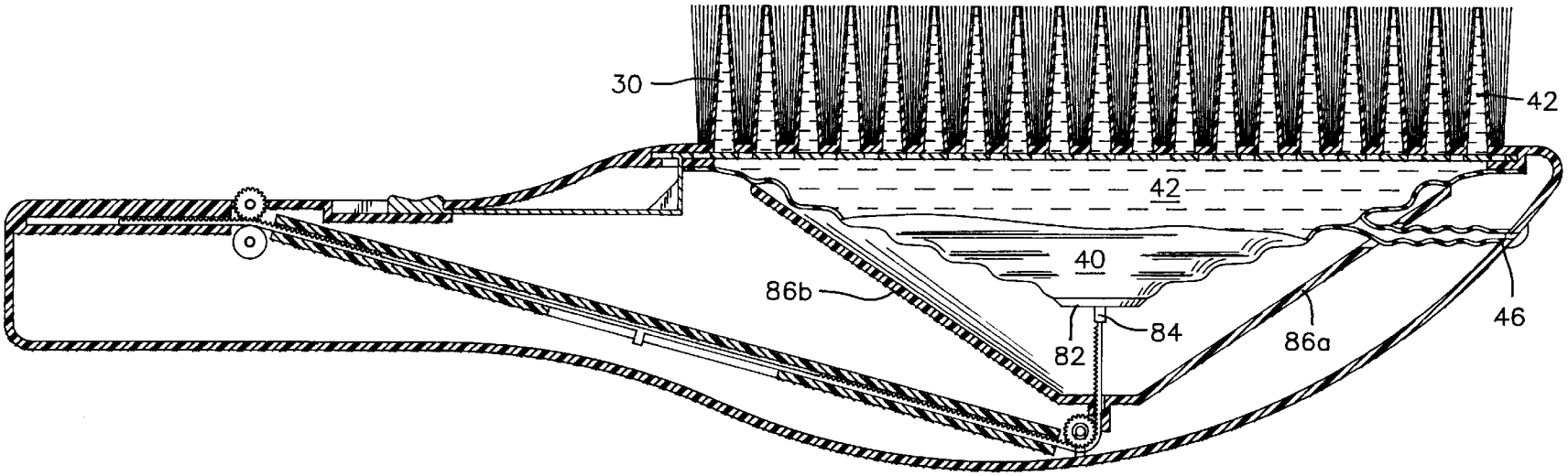
FIG. 2A is a longitudinal sectional view similar to FIG. 2 with a compression plate moved to a position to compress the bellows and force hair gel through a plurality of hollow, tapered dispensing bristles.

Located forward of and behind the bellows 40 are guide ramps 86*a*, 86*b* as shown in FIGS. 2 and 2A. Similarly, left and right side guide ramps 88*a*, 88*b* are shown in FIG. 3. The guide ramps help guide the collapsible bellows 40 as the bellows is compressed by the compression plate 82 as the indexing bar 60 is advanced by the counterclockwise rotation of the thumb wheel 16. Compression plate 82 is secured to bellows 40.

As was explained with reference to the dispensing plate 52, when the apertures 54 of the dispensing plate 52 are in alignment with the base openings 32 of the hollow bristles 30, gel is forced upwardly through the dispensing plate and into the bristles 30 as shown in FIG. 2A. The compression plate 82 is movable in the directions of arrow 88. The movement of the bellows is followed by the spout 44 which is made integral with the bellows and is of a material such that it may become elongated upon stretching, by the flattening of its undulating surface extending between the bellows and the port 46.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A hair brush comprising:

a handle, a head, a plurality of hollow bristles extending from one side of said head, a gel reservoir located in said head, a dispensing plate slidably mounted between said gel reservoir and said hollow bristles, said dispensing plate including a plurality of apertures for allowing gel from said gel reservoir to pass into said hollow bristles when said apertures are aligned with said hollow bristles, a slide switch located on one side of said handle and on a same side of the brush as the bristles, said slide switch moving said dispensing plate, a compression device for forcing gel from said gel reservoir into said hollow bristles through said dispensing plate, and a thumb wheel operable independently of said dispensing plate and located on said one side of said handle adjacent to said slide switch for actuating said compression device.

2. A hair brush as claimed in claim 1, wherein a slide switch in said handle is connected to said dispensing plate for moving said dispensing plate.

3. A hair brush as claimed in claim 1, wherein said hollow bristles taper inwardly from a base to a tip located at a free end of said hollow bristles.

4. A hair brush as claimed in claim 1, wherein said gel reservoir is located between guide plates for guiding movement of said gel reservoir as said gel reservoir is compressed.

5. A hair brush as claimed in claim 4, wherein four guide plates guide said gel reservoir.

6. A hair brush as claimed in claim 1, wherein said compression device includes a compression plate secured to said gel reservoir.

7. A hair brush as claimed in claim 6, wherein a wheel in said handle is rotated to move said compression plate.

8. A hair brush as claimed in claim 7, wherein an indexing bar is connected between said compression plate and said wheel.

9. A hair brush as claimed in claim 8, wherein said indexing bar includes a plurality of projections and recesses for engagement by a plurality of projections and recesses of said wheel.

10. A hair brush as claimed in claim 9, wherein said indexing bar is slidably mounted between upper and lower guide plates.

11. A hair brush for dispensing hair gel, said hair brush comprising:

a hollow body including a handle and a head, a plurality of hollow bristles inter-dispersed between a plurality of rigid bristles projecting from an upper surface of said head, a gel reservoir located in said head, a dispensing plate slidably mounted between said gel reservoir and said hollow bristles, said dispensing plate including a plurality of apertures for allowing gel from said gel reservoir to pass into said hollow bristles when said apertures are aligned with said hollow bristles, a compression device for forcing gel from said gel reservoir into said hollow bristles through said dispensing plate, said compression device including a compression plate secured to said gel reservoir at one end of an indexing bar and an opposite end of said indexing bar extending to said handle and engaging a thumb wheel rotatably mounted in said handle, said thumb wheel and said opposite end of said indexing bar including complementary shaped projections and recesses for moving said indexing bar by rotation of said thumb wheel, and a slide switch located in said handle for movement of said dispensing plate so as to align said apertures of said dispensing plate with openings located at a base of said hollow bristles and allowing gel to be dispensed from said gel reservoir into said base opening,of said hollow bristles and eventually to be forced from a free tip end of said hollow bristles.

12. A hair brush as claimed in claim 11, wherein a ratio of a diameter of said free tip end of said hollow bristles to a diameter of said base opening of said hollow bristles is in the range of 1:1 to 1:4.

13. A hair brush as claimed in claim 12, wherein the ratio in 1:3.

14. A hair brush as claimed in claim 11, wherein a refill passageway extends between a sidewall of said body and said gel reservoir.

15. A hair brush as claimed in claim 14, wherein said gel reservoir is a hollow bellows.

16. A hair brush as claimed in claim 15, wherein said bellows is collapsible by compression of risers and landings formed in an outer surface of said bellows.

17. A hair brush as claimed in claim 11, wherein said indexing bar is slidably mounted between upper and lower guide plates.

18. A hair brush as claimed in claim 11, wherein said one end of said indexing bar extends around a guide wheel.

19. A hair brush as claimed in claim 11, wherein said gel reservoir is located between guide plates for guiding movement of said gel reservoir as said gel reservoir is compressed.

20. A hair brush as claimed in claim 19, wherein four guide plates guide said gel reservoir.

* * * * *